US006681794B2

(12) United States Patent
Tougasaki et al.

(10) Patent No.: US 6,681,794 B2
(45) Date of Patent: Jan. 27, 2004

(54) UNLOADING VALVE

(75) Inventors: Mitsuhisa Tougasaki, Ibaraki-ken (JP); Yoshizumi Nishimura, Tsuchiura (JP); Yusaku Nozawa, Ibaraki-ken (JP); Kinya Takahashi, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 103 days.

(21) Appl. No.: 10/031,169

(22) PCT Filed: May 15, 2001

(86) PCT No.: PCT/JP01/04013

§ 371 (c)(1),
(2), (4) Date: Jan. 17, 2002

(87) PCT Pub. No.: WO01/90618

PCT Pub. Date: Nov. 29, 2001

(65) Prior Publication Data

US 2003/0102027 A1 Jun. 5, 2003

(51) Int. Cl.[7] ..... F16K 17/04
(52) U.S. Cl. ..... 137/115.26; 137/115.13
(58) Field of Search ..... 137/115.01, 115.03, 137/115.13, 115.26; 251/355

(56) References Cited

U.S. PATENT DOCUMENTS

| | | | | | |
|---|---|---|---|---|---|
| 2,732,852 | A | * | 1/1956 | Lauck | 137/115.26 |
| 3,636,969 | A | * | 1/1972 | Jacobellis | 137/115.26 |
| 3,896,856 | A | | 7/1975 | Schumacher et al. | |
| 4,015,620 | A | * | 4/1977 | Carrieri | 137/115.26 |
| 4,796,659 | A | * | 1/1989 | Lehmann | 137/492 |
| 4,832,081 | A | | 5/1989 | Amrhein et al. | |
| 5,305,789 | A | | 4/1994 | Rivolier | |
| 5,694,966 | A | * | 12/1997 | Holder | 137/115.11 |
| 5,771,931 | A | | 6/1998 | Watson | |
| 5,799,688 | A | * | 9/1998 | Yie | 137/505.13 |
| 6,186,750 | B1 | * | 2/2001 | Hunter | 137/115.13 |

FOREIGN PATENT DOCUMENTS

| | | |
|---|---|---|
| DE | 1107039 | 5/1961 |
| DE | 19951417 | 5/2000 |
| EP | 0879979 | 11/1998 |
| EP | 0967398 | 12/1999 |
| GB | 1448722 | 9/1976 |
| JP | 5-30912 | 4/1993 |
| JP | 10-184937 | 7/1998 |

OTHER PUBLICATIONS

International search report on the corresponding PCT application PCT/JP01/04013 filed May 15, 2001.*

* cited by examiner

*Primary Examiner*—Michael Powell Buiz
*Assistant Examiner*—Ramesh Krishnamurthy
(74) *Attorney, Agent, or Firm*—Mattingly, Stanger & Malur, P.C.

(57) ABSTRACT

A spool 33 provided with a flange 39 is inserted in a spool bore 32, and a pressing force of a spring 52 is always applied through the flange 39 to the spool 33 at its one end in a second pressure chamber 35. A fluid groove 60 is formed in an inner peripheral surface of the spool bore 32 at a position near an abutment surface 51. A hydraulic fluid under the same pressure P2 as that in the second pressure chamber 35 is introduced to the fluid groove 60 through a fluid passage 61 formed in a valve body 31. When the flange 39 and the abutment surface 51 are in contact with each other, the hydraulic fluid is allowed to enter the interface between them through the fluid groove 60. A rise of the cracking pressure, which occurs upon the flange coming into tightly close contact with the abutment surface, can be prevented without reducing the strength of the flange 39, and stable opening/closing characteristics of the spool 33 can be achieved.

5 Claims, 6 Drawing Sheets

UNLOADING VALVE

TECHNICAL FIELD

The present invention relates to an unloading valve used in a hydraulic circuit for, e.g., a construction machine, and more particularly to an unloading valve having a spool which is formed with a flange for restricting slide movement of the spool and properly positioning the spool in its neutral state.

BACKGROUND ART

Various hydraulic control valves are conventionally used in a hydraulic circuit for, e.g., a construction machine, and one of those valves is an unloading valve. An unloading valve has the function of releasing the pressure in a hydraulic line when that pressure rises above the reference pressure in excess of a setting value, thereby keeping the pressure in the hydraulic line from rising above the reference pressure in excess of a certain value.

FIG. 5 shows one example of an unloading valve. In FIG. 5, the unloading valve has a valve body 2 in which a spool bore 3 is formed. A first pressure chamber 4 and a second pressure chamber 5 are formed at opposite ends of the spool bore 3, and a reservoir port 6 is formed in an intermediate portion of the spool bore 3. A spool 1 is slidably inserted in the spool bore 3. A hydraulic fluid, of which pressure is to be controlled, is introduced to the first pressure chamber 4, and a hydraulic fluid under a pressure as a reference for control is introduced to the second pressure chamber 5. Further, a flange 7 is formed at an end of the spool 1 on the side of the second pressure chamber 5, and serves as a stopper coming into contact with an abutment surface 8 provided in the valve body 2, thereby preventing the spool 1 from slipping off. The flange 7 also functions as a spring receiver and supports a spring 10 disposed in the second pressure chamber 5.

Further, a transverse hole 1*b* is bored in the spool 1 near its end on the side of the first pressure chamber 4, and is communicated with the first pressure chamber 4 through a longitudinal hole 1*a*.

Assuming in the above-described construction that the pressure of the hydraulic fluid introduced to the first pressure chamber 4 is P1, the pressure of the hydraulic fluid introduced to the second pressure chamber 5 is P2, and the pressing force of the spring 10 is Fk, the spool 1 of the unloading valve operates so as to satisfy the following hydraulic balance formula:

$$P1 \cdot A = P2 \cdot A + Fk \tag{1}$$

Herein, A represents, as shown in FIG. 6, an effective pressure bearing area of each of pressure bearing portions of the spool 1, which are positioned in the first pressure chamber 4 and the second pressure chamber 5. More specifically, on the side of the second pressure chamber 5, a pressure bearing area dA of an annular portion of the flange 7 on one side thereof is the same as that of a corresponding portion of the flange 7 on the opposite side (i.e., the side facing the abutment surface 8). Therefore, pressing forces imposed on those peripheral portions on both the sides of the flange are canceled and the pressure bearing area dA of the annular portion of the flange does not take part in the operation of the spool 1.

Then, when the pressure P1 rises in the formula (1) to such an extent that the differential pressure between the pressure P1 and the pressure P2 exceeds a hydraulic converted value (setting pressure) of the spring force Fk, the hydraulic balance expressed by the formula (1) is lost, whereupon the spool 1 moves to the left in the drawing and the hydraulic fluid in the first pressure chamber 4 is released to the reservoir port 6 through the longitudinal hole 1*a*. Thus, the unloading valve is opened and the pressure P1 is lowered. As a result, the pressure P1 is controlled to be held higher than the pressure P2 by the setting pressure of the spring 10.

Further, FIG. 8 of U.S. Pat. No. 5,305,789 discloses an unloading valve provided with a flange having an outer diameter set as small as possible.

DISCLOSURE OF THE INVENTION

However, the above-described prior art has problems as follows.

The spool 1 of the unloading valve is, as described above, provided with the flange 7. For the necessity of precisely positioning the spool in its neutral state, the flange 7 and the abutment surface 8 of the unloading valve body 2, which comes into contact with the flange 7, are both finished into high flatness. Because of such high flatness, the flange 7 and the abutment surface 8 tend to intimately contact with each other. Further, if the hydraulic fluid under a high pressure is present in the second pressure chamber 5, a very small amount of the hydraulic fluid enters the interface between the flange 7 and the abutment surface 8, whereby adhesion between the flange 7 and the abutment surface 8 is promoted. When the flange 7 and the abutment surface 8 are brought into such a tightly close contact condition, the pressure P2 no longer acts upon one of the opposite sides of the flange 7, i.e., the side of the flange 7 facing the abutment surface 8. Hence, the pressure bearing area dA of the annular portion of the flange 7 becomes effective in pressure balance and the pressure bearing area on the side of the second pressure chamber 5 is increased from A to A+dA.

Accordingly, the hydraulic balance formula for the spool 1 is expressed by:

$$P1 \cdot A = P2 \cdot (A + dA) + Fk \tag{2}$$

Comparing the formula (1) and (2) with each other, it is seen that, as a result of the flange 7 coming into tightly close contact with the abutment surface 8, the cracking pressure, at which the spool 1 starts moving to the left in the drawing and the unloading valve is opened, is increased by a value of P2·dA/A. Consequently, the proper operation of the unloading valve is impeded.

In the unloading valve shown in FIG. 8 of U.S. Pat. No. 5,305,789, the outer diameter of the flange 7 is set as small as possible. FIG. 7 shows a modification of the unloading valve shown in FIGS. 5 and 6, which has the flange 7 having the outer diameter set as small as possible based on the concept of the US Patent. In FIG. 7, character 7A denotes a flange having a reduced outer diameter. With the flange 7A having the reduced outer diameter, an increase in pressure bearing area of the flange 7A, which occurs on the side facing the interior of the second pressure chamber 5 when the flange 7A comes into tightly close contact with the abutment surface 8, is reduced from dA to dA' and a rise of the cracking pressure is also suppressed. It is however impossible to perfectly prevent a rise of the cracking pressure, which occurs upon the flange 7A coming into tightly close contact with the abutment surface 8. Reducing the outer diameter of the flange 7A causes another problem in that the strength of the flange 7A deteriorates.

For example, when an unloading valve is used in a hydraulic circuit for load sensing control (hereinafter referred to as "LS control") of a hydraulic pump, the pressure P1 is given by a delivery pressure of the hydraulic pump and the pressure P2 is given by a load pressure of an actuator (maximum load pressure). Then, the unloading valve functions to hold the differential pressure between the pump delivery pressure and the maximum load pressure at a setting value. In that case, a high load pressure at a level of, e.g., 300 MPa may act momentarily in the second pressure chamber 5 at the startup of the actuator. This means that the flange 7A of the spool 1 hits against the abutment surface 8 under an action of the high pressure of 300 MPa and is subjected to a great impact force. For that reason, there occurs a risk that the strength of the flange 7A having the reduced outer diameter is deteriorated to such an extent as not withstanding the great impact force, and the flange 7A is broken.

It is an object of the present invention to provide an unloading valve capable of preventing a rise of the cracking pressure, which occurs upon a flange coming into tightly close contact with an abutment surface, without reducing the strength of the flange.

(1) To achieve the above object, the present invention provides an unloading valve comprising a valve body having a first pressure chamber, a second pressure chamber and a spool bore; a spool having a spool body inserted in the spool bore such that one end of the spool is positioned in the first pressure chamber and the other end of the spool is positioned in the second pressure chamber; a flange provided at the end of the spool on the side of the second pressure chamber and coming into contact with an abutment surface formed on the side of the valve body, thereby properly positioning the spool body in a neutral state; and a spring disposed in the second pressure chamber and biasing the spool such that the flange contacts the abutment surface on the side of the valve body, the spool being moved toward the side of the second pressure chamber when a pressure in the first pressure chamber rises above a pressure in the second pressure chamber in excess of a setting value of the spring, thereby releasing the pressure in the first pressure chamber to a reservoir, wherein at least one of the valve body and the spool body includes hydraulic pressure guiding means for introducing a hydraulic fluid under the same pressure as that in the second pressure chamber to an interface between the flange and the abutment surface on the side of the valve body.

By providing the hydraulic pressure guiding means which introduces the hydraulic fluid under the same pressure as that in the second pressure chamber to the interface between the flange and the abutment surface on the side of the valve body, even when the pressure in the second pressure chamber rises to a high level, the interface between the flange and the abutment surface is also subjected to the pressure at the same level, whereby the flange and the abutment surface are avoided from coming into tightly close contact with each other. As a result, a rise of the cracking pressure, which occurs upon the flange coming into tightly close contact with the abutment surface, can be prevented without reducing the strength of the flange.

(2) In the unloading valve of above (1), preferably, the hydraulic pressure guiding means comprises a circumferential fluid groove formed in an inner peripheral surface of the spool bore in the valve body at a position near the abutment surface, and a fluid passage for introducing the hydraulic fluid under the same pressure as that in the second pressure chamber to the circumferential fluid groove.

With that feature, the hydraulic fluid introduced to the circumferential fluid groove reaches the interface between the flange and the abutment surface through a small gap between sliding surfaces of the spool bore and the spool body. Therefore, the interface between the flange and the abutment surface is also subjected to the same pressure as that in the second pressure chamber.

(3) In the unloading valve of above (1), preferably, the hydraulic pressure guiding means comprises a circumferential fluid groove formed in an outer peripheral surface of the spool body of the spool at a position near the abutment surface, and a fluid passage for introducing the hydraulic fluid under the same pressure as that in the second pressure chamber to the circumferential fluid groove.

With that feature, the hydraulic fluid introduced to the circumferential fluid groove reaches the interface between the flange and the abutment surface through a small gap between sliding surfaces of the spool bore and the spool body. Therefore, the interface between the flange and the abutment surface is also subjected to the same pressure as that in the second pressure chamber.

(4) In the unloading valve of above (1), preferably, the hydraulic pressure guiding means comprises a circumferential fluid groove formed at an opening end of the spool bore in the valve body on the side of the second pressure chamber, and a fluid passage for introducing the hydraulic fluid under the same pressure as that in the second pressure chamber to the circumferential fluid groove.

With that feature, the hydraulic fluid introduced to the circumferential fluid groove is directly introduced to the interface between the flange and the abutment surface, whereby that interface is also subjected to the same pressure as that in the second pressure chamber.

(5) In the unloading valve of above (1), preferably, the hydraulic pressure guiding means comprises fluid grooves formed in the abutment surface on the side of the valve body and always partly opened to the second pressure chamber.

With that feature, the hydraulic fluid under the same pressure as that in the second pressure chamber is directly introduced to the interface between the flange and the abutment surface.

BEST MODE FOR CARRYING OUT THE INVENTION

Embodiments of the present invention will be described below with reference to the drawings.

Figure 1:
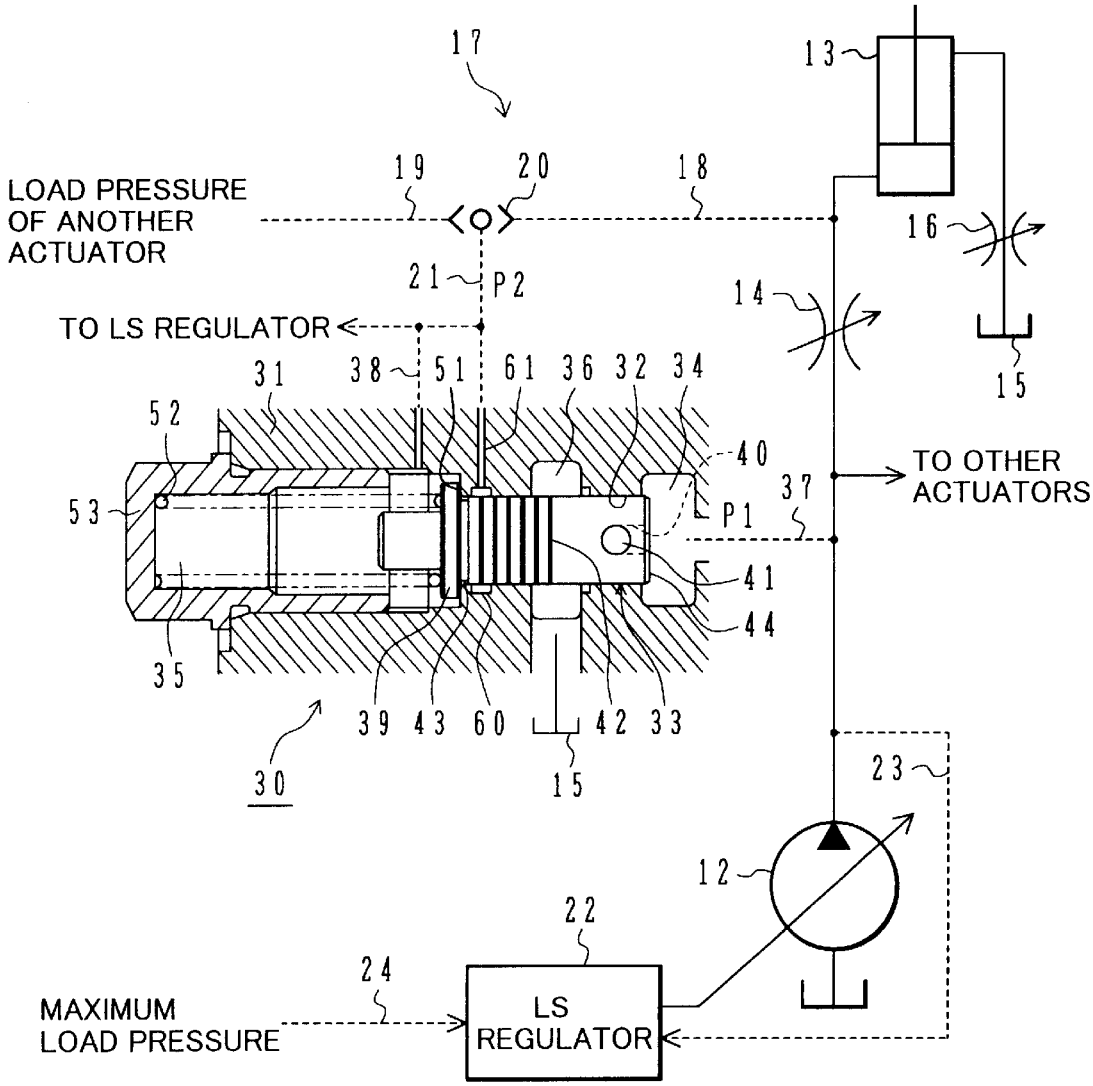
FIG. 1 includes an axial longitudinal sectional view of an unloading valve according to a first embodiment of the present invention, and a system arrangement diagram showing the case in which the unloading valve is applied to, by way of example, to an LS control hydraulic circuit.

FIG. 1 shows an unloading valve according to a first embodiment of the present invention along with a hydraulic circuit. This embodiment represents the case in which the present invention is applied to an unloading valve used in a hydraulic circuit for load sensing control of a hydraulic pump.

Referring to FIG. 1, the hydraulic circuit for use with this embodiment comprises a hydraulic pump 12; a plurality of actuators including a hydraulic actuator 13 driven by a hydraulic fluid delivered from the hydraulic pump 12; a meter-in variable throttle 14 for controlling a flow rate of the hydraulic fluid supplied from the hydraulic pump 12 to the hydraulic actuator 13; a meter-out variable throttle 16 for controlling a flow rate of the hydraulic fluid drained from the hydraulic actuator 13 to a reservoir 15; and a maximum load pressure detecting circuit 17 for detecting a maximum one among load pressures of the plurality of actuators. The maximum load pressure detecting circuit 17 is connected to the downstream side of the meter-in variable throttle 14. The circuit 17 comprises a load pressure detecting line 18 for detecting the load pressure of the hydraulic actuator 13; a similar load pressure detecting line 19 for detecting the load pressure of another actuator; a shuttle valve 20 for selecting a higher one of the pressure in the load pressure detecting line 18 and the pressure in the load pressure detecting line 19; and a maximum load pressure line 21 for outputting the pressure (maximum load pressure) selected by the shuttle valve 20.

The hydraulic pump 12 is of the variable displacement type, and a tilting of its swash plate (i.e., pump displacement capacity or volume) is controlled by a load sensing regulator (hereinafter referred to as an "LS regulator") 22. More specifically, to the LS regulator 22, there are introduced the delivery pressure of the hydraulic pump 12 via a signal line 23 and the maximum load pressure detected by the maximum load pressure line 21 via a signal line 24. Then, the LS regulator 22 controls the tilting of the swash plate of the hydraulic pump 12 so that the delivery pressure of the hydraulic pump 12 is held higher than the maximum load pressure by a predetermined value $\Delta P_{LSO}$.

Further, the hydraulic circuit includes a pressure compensating valve (not shown) for holding the differential pressure across the meter-in variable throttle 14 constant.

An unloading valve 30 of this embodiment is provided in the hydraulic circuit having the above-described arrangement. The unloading valve 30 has a valve body 31 in which a spool bore 32 is formed. A spool 33 is slidably inserted in the spool bore 32. Inside the valve body 31, a first pressure chamber 34 and a second pressure chamber 35 are formed corresponding to opposite ends of the spool 33, and a reservoir port 36 is formed between the first pressure chamber 34 and the second pressure chamber 35 in a surrounding relation to the spool 33. The first pressure chamber 34 is connected to a delivery line 12*a* of the hydraulic pump 12 via a signal line 37, the second pressure chamber 35 is connected to the maximum load pressure line 21 via a signal line 38, and the reservoir port 36 is connected to the reservoir 15.

The spool 33 comprises a spool body 44 and a flange 39. A longitudinal hole 40 is formed in an end portion 33*a* of the spool body 44 on the side of the first pressure chamber 34, and a transverse hole 41 communicating with the longitudinal hole 40 is formed near that spool end portion. When the first pressure chamber 33 is moved to the left in the drawing, the first pressure chamber 34 is can be communicated with the reservoir port 36 through the longitudinal hole 40 and the transverse hole 41. Also, a plurality of circumferential lubricant grooves 42 are formed in an outer peripheral surface of the spool body 44 for smooth sliding of the spool body 44. Additionally, a circumferential spill groove 43 is formed at the boundary between the spool body 44 and the flange 39.

The flange 39 is formed at an end of the spool body 44 on the side of the second pressure chamber 35, and serves as a stopper for restricting movement of the spool 33 to the right in the drawing, thereby properly positioning the spool 33 in its neutral state and preventing the spool 33 from slipping off. An abutment surface 51, with which the flange 39 comes into contact, is formed inside the valve body 31 as an inner end surface of the second pressure chamber 35. The flange 39 also functions as a spring receiving portion and supports one end of a spring 52 disposed in the second pressure chamber 35. The second pressure chamber 35 is closed by a cap 53, and the other end of the spring 52 is supported by the cap 53. The spring 52 presses the spool 33 to the right in the drawing and sets a target differential pressure of the unloading valve 30.

The thus-constructed unloading valve 30 of this embodiment includes, as novel features, a circumferential fluid groove 60 formed in an inner peripheral surface of the spool bore 32 in the valve body 31 at a position near the abutment surface 51, and a fluid passage 61 communicating with the fluid groove 60. The fluid passage 61 is connected to the maximum load pressure line 21. Thus, since the fluid passage 61 is connected to the maximum load pressure line 21 and the second pressure chamber 35 is connected to the maximum load pressure line 21 via the signal line 38, the hydraulic fluid under the same pressure as that in the second pressure chamber 35 is introduced to the fluid groove 60 as well.

In this embodiment described above, the spool bore 32 and the abutment surface 51 are directly formed in the valve body 31. Alternatively, a cartridge including a spool bore and an abutment surface formed therein may be prepared and assembled in the valve body. In such a case, the fluid groove 60 is also formed in the cartridge.

The operation of the thus-constructed unloading valve 30 of this embodiment will be described below.

The basic operation of the unloading valve 30 is the same as that of a conventional unloading valve. More specifically, assuming that the pressure of the hydraulic fluid introduced to the first pressure chamber 34 is P1, the pressure of the hydraulic fluid introduced to the second pressure chamber 35 is P2, and the pressing force of the spring 52 is Fk, the spool 33 of the unloading valve 30 operates so as to satisfy the following hydraulic balance formula (1), which has been mentioned above in connection the problems to be solved by the invention:

$$P1 \cdot A = P2 \cdot A + Fk \quad (1)$$

Figure 6:
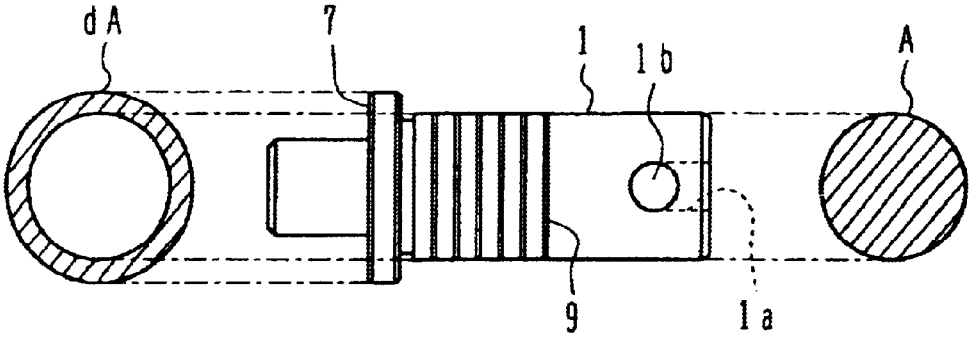
FIG.6 PRIOR ART
FIG. 6 is an explanatory view for explaining a cross-sectional area A of a spool body and an area dA of an annular portion corresponding to an outer peripheral portion of the spool body.
Figure 7:
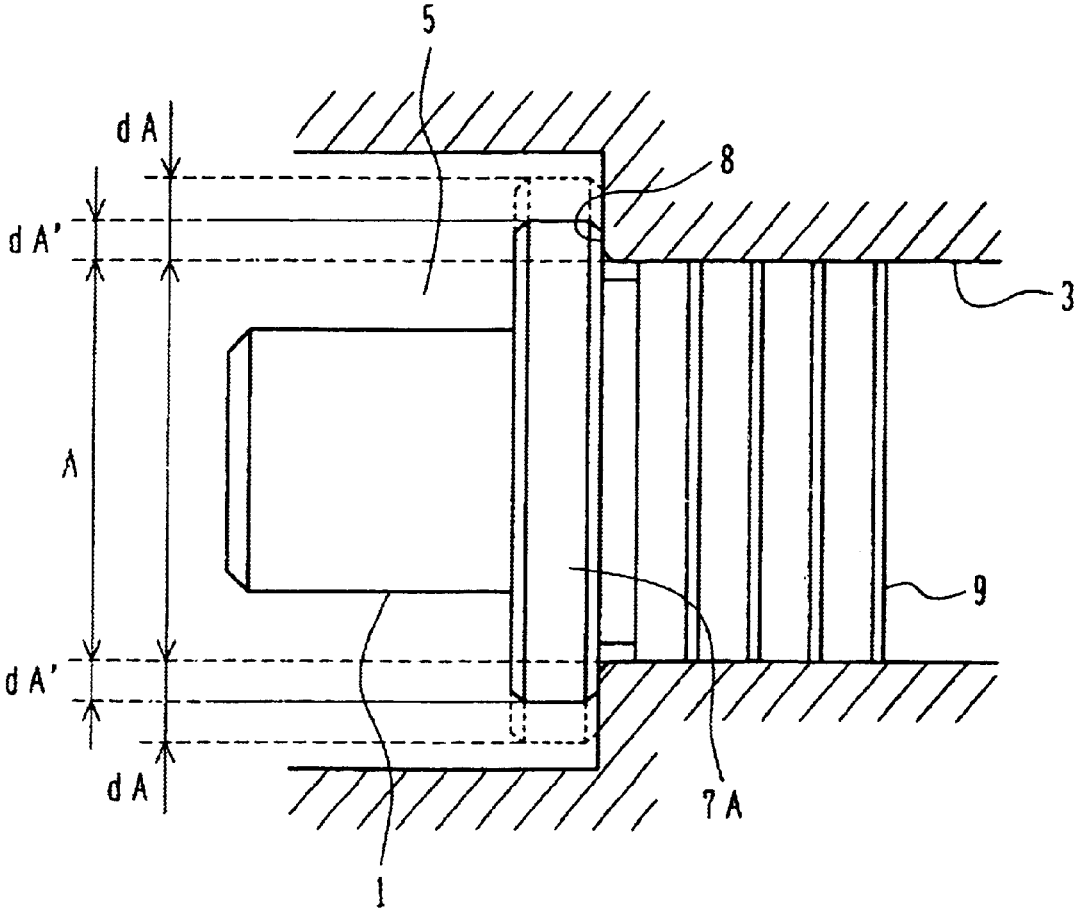
FIG.7 PRIOR ART
FIG. 7 is a partial axial longitudinal sectional view of an unloading valve provided with a flange having a reduced outer diameter, showing a region around the flange and an abutment surface.

Herein, A represents an effective pressure bearing area of each of pressure bearing portions of the spool 33, which are positioned in the first pressure chamber 34 and the second pressure chamber 35. Stated otherwise, on the side of the second pressure chamber 35, a pressure bearing area dA (see FIG. 6) of an annular portion of the flange 39 on one side thereof is the same as that of a corresponding portion of the flange 39 on the opposite side (i.e., the side facing the abutment surface 51). Therefore, pressing forces imposed on those peripheral portions on both the sides of the flange are canceled and the pressure bearing area dA of the annular portion of the flange does not take part in the operation of the spool 33.

Then, when the pressure P1 rises in the formula (1) to such an extent that the differential pressure between the pressure P1 and the pressure P2 exceeds a hydraulic converted value (setting pressure) of the spring force Fk, the hydraulic balance expressed by the formula (1) is lost, whereupon the spool 33 moves to the left in the drawing and the hydraulic fluid in the first pressure chamber 34 is released to the reservoir port 36 through the longitudinal hole 40. Thus, the unloading valve 30 is opened and the pressure P1 is lowered. As a result, the pressure P1 is controlled to be held higher than the pressure P2 by the setting pressure of the spring 52.

In the conventional unloading valve, as described above, since the flange 39 and the abutment surface 51 are both finished into high flatness, the flange 39 and the abutment surface 51 tend to tightly stick together when they are contacted with each other under a strong force, whereby the pressure bearing area dA (see FIG. 6) of the annular portion of the flange 39 becomes effective. As a result, the cracking pressure, at which the spool 33 starts moving from the illustrated condition to the left in the drawing and the unloading valve 30 is opened, is increased by a value of P2·dA/A.

In contrast, the unloading valve 30 includes the fluid groove 60 and the fluid passage 61. The hydraulic fluid under the same pressure as the pressure P2 in the second pressure chamber 35 is introduced to the fluid groove 60. The hydraulic fluid introduced to the fluid groove 60 enters a small gap between sliding surfaces of the spool bore 32 and the spool body 44 from the fluid groove 60, and further reaches the interface between the flange 39 and the abutment surface 51. Therefore, even when the pressure in the second pressure chamber 35 rises to a high level, the interface between the flange 39 and the abutment surface 51 is also subjected to the same pressure as that in the second pressure chamber 35. The flange 39 and the abutment surface 51 are avoided from coming into tightly close contact with each other, and the pressure bearing area dA of the annular portion of the flange 39 will not become effective. As a result, the unloading valve 30 can be opened without causing a rise of the cracking pressure corresponding to dA, and the stable operation of the unloading valve 30 can be achieved.

Also, in this embodiment, since there is no need of reducing the outer diameter of the flange 39 of the spool 33, a rise of the cracking pressure, which occurs upon the flange 39 coming into tightly close contact with the abutment surface 51, can be prevented without reducing the strength of the flange 39. Accordingly, during the load sensing control of the hydraulic pump 12 by the LS regulator 22, even when a high load pressure at a level of, e.g., 300 MPa acts momentarily in the second pressure chamber 35 at the startup of the hydraulic actuator 13 and the flange 39 hits against the abutment surface 51 with a great impact under an action of that high pressure, the flange 39 is sufficiently endurable against such a great impact.

Figure 2:
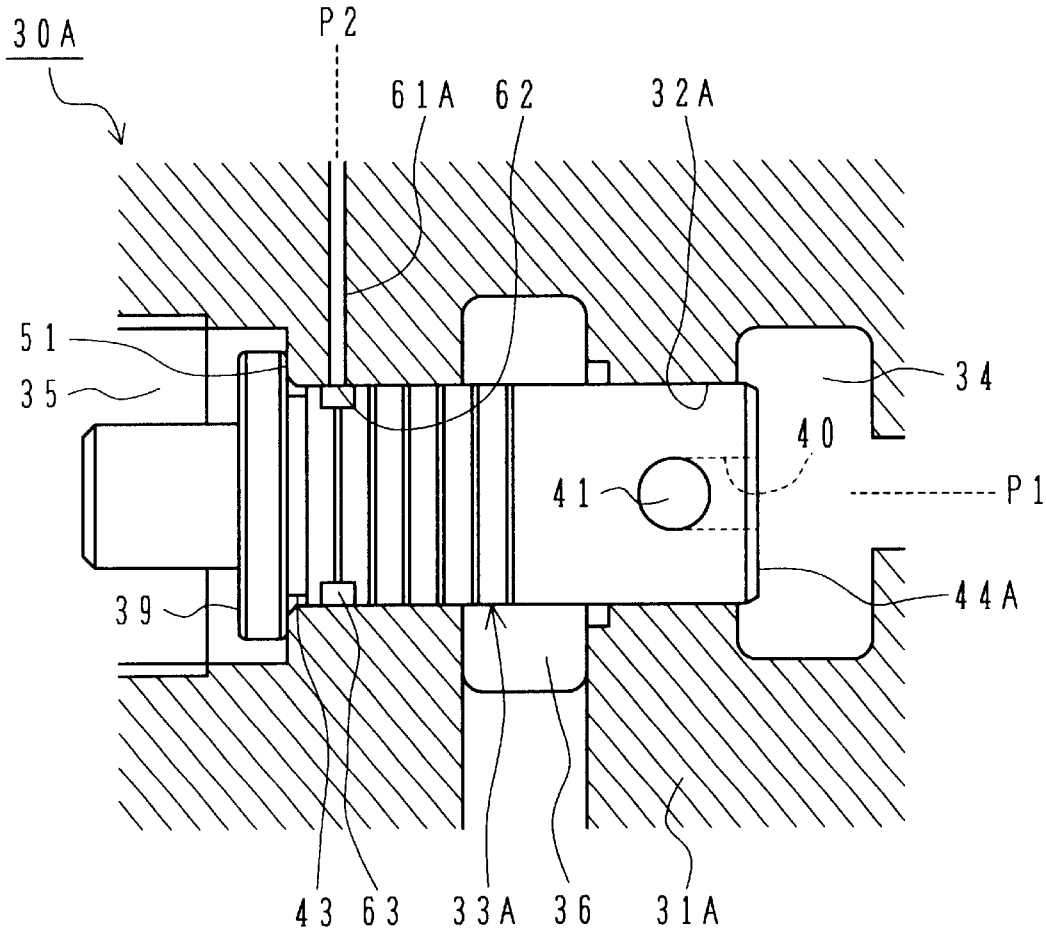
FIG. 2 is a partial axial longitudinal sectional view of an unloading valve according to a second embodiment of the present invention, showing a region around a spool bore.

A second embodiment of the present invention will be described with reference to FIG. 2. FIG. 2 is a partial axial longitudinal sectional view of an unloading valve according to this embodiment, showing a region around a spool bore and a spool. In FIG. 2, identical components to those shown in FIG. 1 are denoted by the same characters. While the fluid groove is formed in the inner peripheral surface of the spool bore in the first embodiment of FIG. 1, the fluid groove is formed in the outer peripheral surface of the spool body in this embodiment.

Referring to FIG. 2, an unloading valve 30A of this embodiment includes a spool 33A comprising a spool body 44A and a flange 39. A circumferential fluid groove 63 is formed in an outer peripheral surface of the spool body 44A at a position near the flange 39. Also, a fluid passage 61A is formed in a valve body 31A and has a hydraulic fluid port 62 which is opened to the fluid groove 63 at a sliding surface of a spool bore 32A in the illustrated position where the unloading valve 30A is closed. As with the first embodiment, the fluid passage 61A is connected to the maximum load pressure line 21 (see FIG. 1). Thus, the hydraulic fluid under the same pressure as that in the second pressure chamber 35 is introduced to the fluid groove 63.

In this embodiment having the construction described above, as with the first embodiment, the hydraulic fluid introduced to the fluid groove 63 reaches the interface between the flange 39 and the abutment surface 51 through a small gap between sliding surfaces of the spool bore 32A and the spool body 44A. Therefore, the interface between the flange 39 and the abutment surface 51 is also subjected to the same pressure as the pressure P2 in the second pressure chamber 35. As a result, a rise of the cracking pressure, which occurs upon the flange 39 coming into tightly close contact with the abutment surface 51, can be prevented without reducing the strength of the flange 39, and the stable operation of the spool 33A can be achieved.

Figure 3:
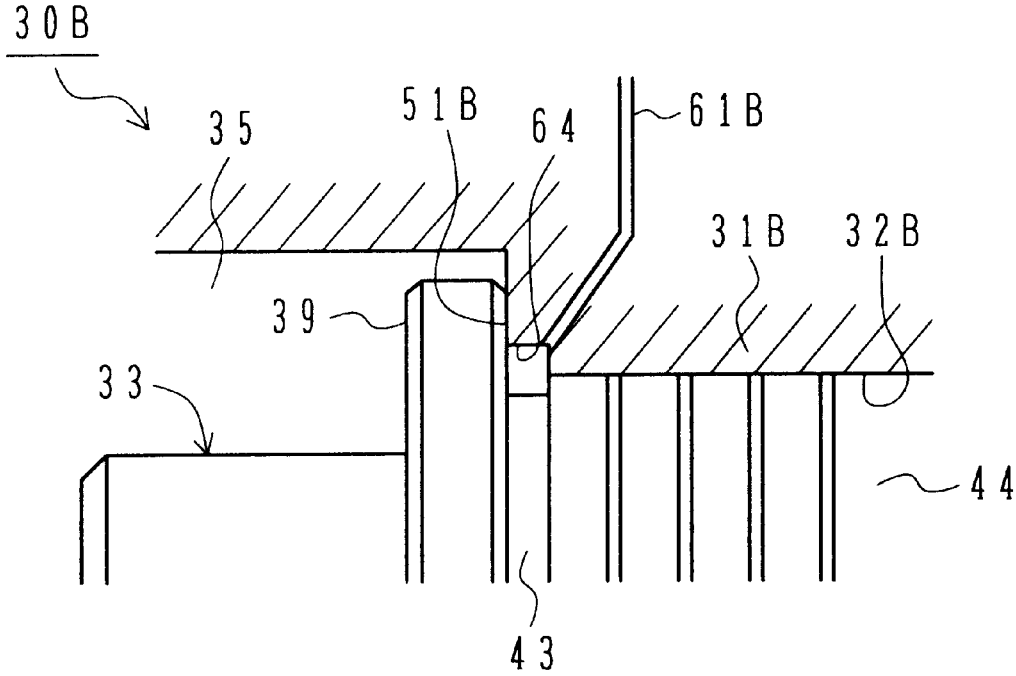
FIG. 3 is a partial axial longitudinal sectional view of an unloading valve according to a third embodiment of the present invention, showing a region around a flange and an abutment surface.

A third embodiment of the present invention will be described with reference to FIG. 3. FIG. 3 is a partial axial longitudinal sectional view of an unloading valve according to this embodiment, showing a region around a flange and an abutment surface. In FIG. 3, identical components to those shown in FIG. 1 are denoted by the same characters. While the fluid groove is formed midway the sliding surface of the spool bore in the first embodiment of FIG. 1, the fluid groove is formed at an opening end of the spool bore in this embodiment.

Referring to FIG. 3, an unloading valve 30B of this embodiment has a valve body 31B in which a spool bore 32B is formed. A spool 33 is slidably inserted in the spool bore 32B. The spool 33 comprises a spool body 44 and a flange 39. Inside the valve body 31B, a second pressure chamber 35 is formed at one end of the spool bore 32B on the left side in the drawing. Also, an abutment surface 51B, with which the flange 39 comes into contact, is formed inside the valve body 31B as an inner end surface of the second pressure chamber. Then, a circumferential fluid groove 64 is formed at a right-angled corner between the spool bore 32B and the abutment surface 51B, i.e., at an opening end of the spool bore 32B in the valve body 31B on the side of the second pressure chamber 35. Further, as with the first and second embodiments, a fluid passage 61B is formed in the valve body 31B for connecting the fluid groove 64 to the maximum load pressure line 21 (see FIG. 1). Thus, the hydraulic fluid under the same pressure as that in the second pressure chamber 35 is introduced to the fluid-groove 64.

In this embodiment having the construction described above, the hydraulic fluid under the same pressure as the pressure P2 in the second pressure chamber 35 can be directly introduced to the interface between the flange 39 and the abutment surface 51B. Therefore, a rise of the cracking pressure, which occurs upon the flange 39 coming into tightly close contact with the abutment surface 51B, can be prevented without reducing the strength of the flange 39, and the stable operation of the spool 33 can be achieved.

Moreover, a circumferential spill groove 43 is usually formed at the boundary between the spool body 44 and the flange 39 of the spool 33 as illustrated in this embodiment. Since the fluid groove 64 is formed at the opening end of the spool bore 32B in this embodiment, a combination of the fluid groove 64 and the spill groove 43 increases the volume of a space, to which the hydraulic fluid is introduced. It is hence possible to more effectively prevent the flange 39 from coming into tightly close contact with the abutment surface 51B, and to avoid a rise of the cracking pressure.

While, in this embodiment described above, the fluid groove 64 is formed at the opening end of the spool bore 32B, the spill groove may be utilized as the fluid groove without forming a special fluid groove, and the fluid passage 61B may be directly opened to the spill groove 43 formed in the spool 33. Also in such a case, the hydraulic fluid under the same pressure as the pressure P2 in the second pressure chamber 35 can be directly introduced to the interface between the flange 39 and the abutment surface 51B. Therefore, a rise of the cracking pressure, which occurs upon the flange 39 coming into tightly close contact with the abutment surface 51B, can be prevented without reducing the strength of the flange 39, and the stable operation of the spool 33 can be achieved.

Figure 4A:
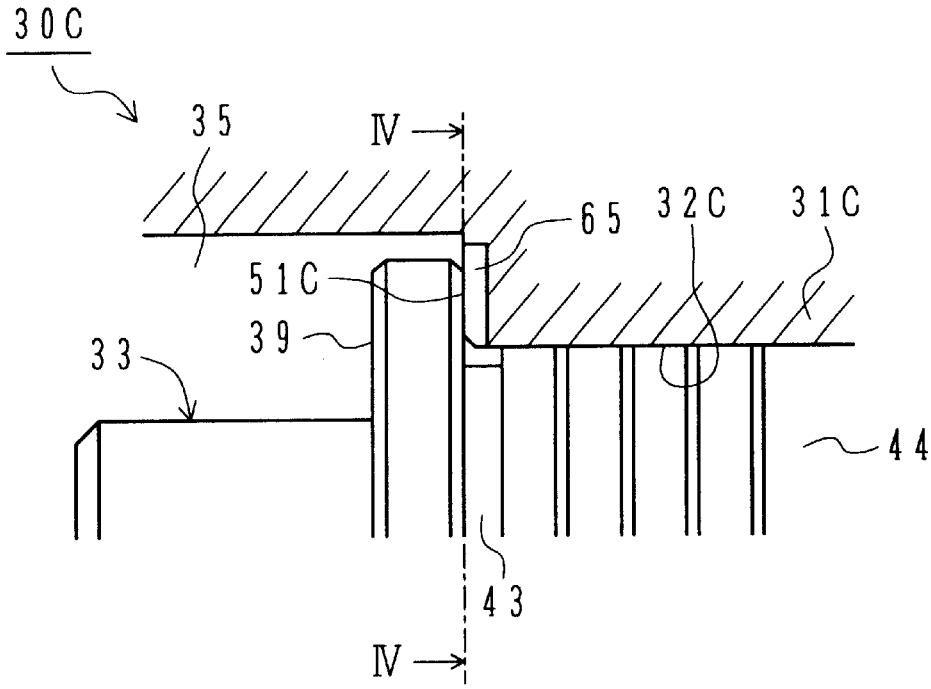
FIG. 4A is a partial axial longitudinal sectional view of an unloading valve according to a fourth embodiment of the present invention, showing a region around a flange and an abutment surface.
Figure 4B:
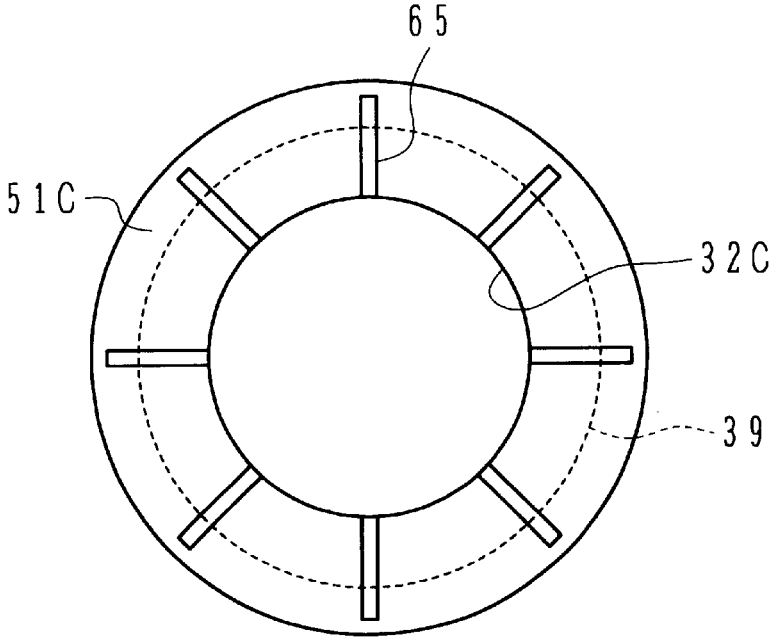
FIG. 4B is a view taken along line IV—IV in FIG. 4A, looking from the direction of arrows.
Figure 5:
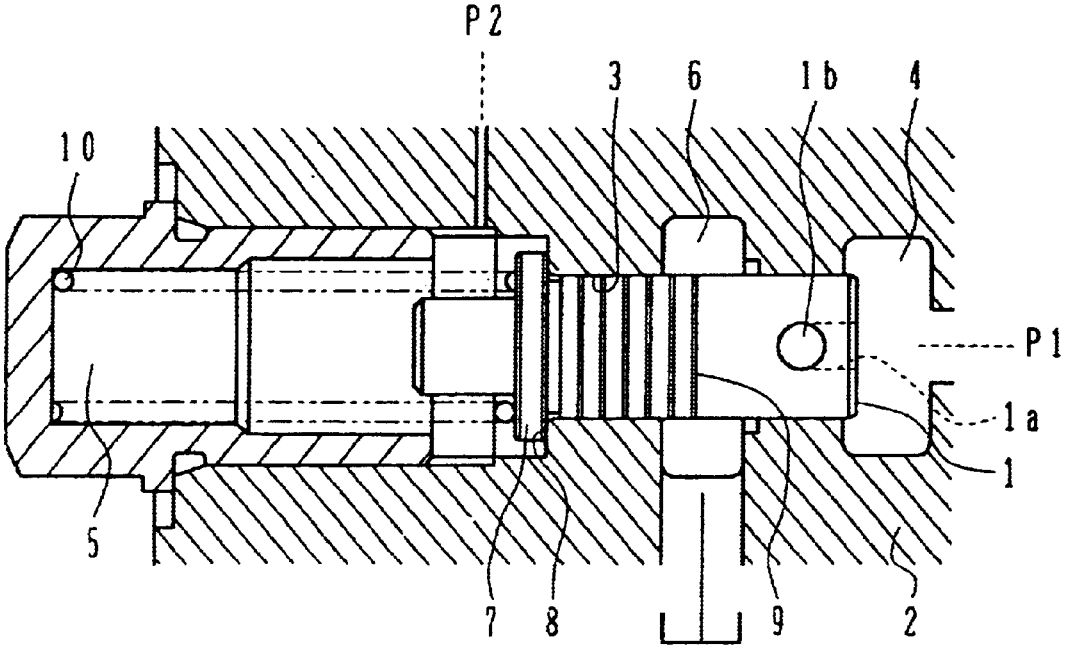
FIG.5 PRIOR ART
FIG. 5 is an axial longitudinal sectional view of an unloading valve.

A fourth embodiment of the present invention will be described with reference to FIGS. 4A and 4B. FIG. 4A is a partial axial longitudinal sectional view of an unloading valve according to this embodiment, showing a region around a flange and an abutment surface, and FIG. 4B is a view taken along line IV—IV in FIG. 4A, looking from the direction of arrows. In FIGS. 4A and 4B, identical components to those shown in FIG. 1 are denoted by the same characters. While the fluid groove is formed at the opening end of the spool bore on the side of the second pressure chamber in the third embodiment of FIG. 3, the fluid groove is formed in the abutment surface in this embodiment.

Referring to FIG. 4, an unloading valve 30C of this embodiment has a valve body 31C in which a spool bore 32C is formed. A spool 33 is slidably inserted in the spool bore 32C. The spool 33 comprises a spool body 44 and a flange 39. Inside the valve body 31B, a second pressure chamber 35 is formed at one end of the spool bore 32B on the left side in the drawing. Also, an abutment surface 51C, with which the flange 39 comes into contact, is formed inside the valve body 31B as an inner end surface of the second pressure chamber. A plurality, e.g., eight, of fluid groove 65 radially extending from the center of the spool bore 32C are formed in the abutment surface 51C at equal angular intervals. Each of the fluid grooves 65 has an inner end opened to the inner peripheral surface of the spool bore 32C at the opening end thereof, and has an outer end positioned radially outward of an area in which the flange 39 and the abutment surface 51C contact with each other. Thus, the hydraulic fluid under the same pressure as that in the second pressure chamber 35 is introduced to the fluid grooves 65.

In this embodiment having the construction described above, when the flange 39 and the abutment surface 51C are in contact with each other, the hydraulic fluid under the same pressure as the pressure P2 in the second pressure chamber 35 can be evenly and directly introduced to the interface between the flange 39 and the abutment surface 51C. Therefore, a rise of the cracking pressure, which occurs upon the flange 39 coming into tightly close contact with the abutment surface 51C, can be prevented without reducing the strength of the flange 39, and the stable operation of the spool 33 can be achieved.

Taking into account the size of the abutment surface 51C, the number of the fluid grooves 65 is preferably at least eight. Anyway, including the case of forming the fluid grooves in number more than eight, the fluid grooves 65 are preferably formed at equal angular intervals so that the pressure of the hydraulic fluid can be evenly introduced to the abutment surface 51C.

Additionally, the fluid grooves 65 may be arranged in the form of plural concentric circles having different diameters, for example, rather than being radially arranged as with this embodiment. In such a case, the concentric fluid grooves may be combined with several radial fluid grooves so that the hydraulic fluid under the same pressure as that in the second pressure chamber 35 can be introduced to the concentric fluid grooves. Alternatively, a fluid passage may be formed inside the valve body as with the embodiment of, e.g., FIG. 1, so that the hydraulic fluid under the same pressure as that in the second pressure chamber 35 can be introduced to the concentric fluid grooves.

INDUSTRIAL APPLICABILITY

According to the present invention, the hydraulic fluid under the same pressure as that in the second pressure chamber is introduced to the interface between the flange and the abutment surface on the valve body side. Even with the pressure in the second pressure chamber rising to a high level, therefore, the same high pressure is also introduced to the interface between the flange and the abutment surface, whereby the flange and the abutment surface are avoided from coming into tightly close contact with each other. As a result, a rise of the cracking pressure, which occurs upon the flange coming into tightly close contact with the abutment surface, can be prevented without reducing the strength of the flange.

What is claimed is:

1. An unloading valve (30) comprising:

a valve body (31) having a first pressure chamber (34), a second pressure chamber (35) and a spool bore (32);

a spool (33) having a spool body (44) inserted in said spool bore such that one end of said spool is positioned in said first pressure chamber and the other end of said spool is positioned in said second-pressure chamber;

a flange (39) provided at the end of said spool on the side of said second pressure chamber and coming into contact with an abutment surface (51) formed on the side of said valve body, thereby properly positioning said spool body in a neutral state; and a spring (52) disposed in said second pressure chamber and biasing said spool such that said flange contacts said abutment surface on the side of said valve body, said spool being moved toward the side of said second pressure chamber when a pressure in said first pressure chamber rises above a pressure in said second pressure chamber in excess of a setting value of said spring, thereby releasing the pressure in said first pressure chamber to a reservoir (15), wherein at least one of said valve body (31) and said spool body (44) includes hydraulic pressure guiding means (60, 61) for introducing a hydraulic fluid under the same pressure as that in said second pressure chamber (35) to an interface between said flange (39) and said abutment surface (51) on the side of said valve body.

2. An unloading valve according to claim 1, wherein said hydraulic pressure guiding means comprises a circumferential fluid groove (60) formed in an inner peripheral surface of the spool bore (32) in said valve body (31) at a position near said abutment surface, and a fluid passage (61) for introducing the hydraulic fluid under the same pressure as that in said second pressure chamber (35) to said circumferential fluid groove.

3. An unloading valve according to claim 1, wherein said hydraulic pressure guiding means comprises a circumferential fluid groove (63) formed in an outer peripheral surface of the spool body (44A) of said spool (33A) at a position near said abutment surface (51), and a fluid passage (61A) for introducing the hydraulic fluid under the same pressure as that in said second pressure chamber (35) to said circumferential fluid groove.

4. An unloading valve according to claim 1, wherein said hydraulic pressure guiding means comprises a circumferential fluid groove (64) formed at an opening end of the spool bore (32B) in said valve body (31B) on the side of said second pressure chamber (35), and a fluid passage (61B) for introducing the hydraulic fluid under the same pressure as that in said second pressure chamber (35) to said circumferential fluid groove.

5. An unloading valve according to claim 1, wherein said hydraulic pressure guiding means comprises fluid grooves (65) formed in said abutment surface (51C) on the side of said valve body (31C) and always partly opened to said second pressure chamber (35).

* * * * *